United States Patent [19]

Regina

[11] Patent Number: 4,576,189

[45] Date of Patent: Mar. 18, 1986

[54] PARTIAL WIG ASSEMBLY WITH EXTENSION PORTION

[76] Inventor: Ruth Regina, 1050 Kane Concourse, Bay Harbor Island, Fla. 33154

[21] Appl. No.: 706,697

[22] Filed: Feb. 28, 1985

Related U.S. Application Data

[63] Continuation of Ser. No. 572,304, Jan. 20, 1984, abandoned.

[51] Int. Cl.[4] ..... A41G 3/00

[52] U.S. Cl. ..... 132/53

[58] Field of Search ..... 132/53, 54, 55, 56; 2/183, 197

[56] References Cited

U.S. PATENT DOCUMENTS

| | | | |
|---|---|---|---|
| 1,424,845 | 8/1922 | Nolan | 132/53 |
| 1,545,881 | 7/1925 | Cohen | 132/54 |
| 3,307,563 | 3/1967 | Regina | 132/53 |
| 3,444,865 | 5/1969 | De Vita | 132/53 |
| 3,884,248 | 5/1975 | Mendelson et al. | 132/53 |
| 4,214,033 | 7/1980 | Clifton et al. | 132/53 |
| 4,386,619 | 6/1983 | Williams | 132/53 |

*Primary Examiner*—Gene Mancene
*Assistant Examiner*—Carolyn A. Harrison
*Attorney, Agent, or Firm*—John Cyril Malloy

[57] ABSTRACT

This invention relates to a wig or hairpiece, and more particularly, to a wig having a central opening therethrough with wig portions having hair which is adapted to be intermingled with the natural hair of a wearer to supplement it in those areas which ordinarily require treatment for more sophisticated hair stylings. A foundation having a substantially elliptical configuration is structured to fit in overlying relation adjacent a frontal portion of the head of the wearer and an extension portion formed of porous, light, flexible material structured for ventilation of the scalp therethrough extends rearwardly of the foundation into the central opening to add additional body to the natural styling of hair and versatility by providing additional hair capable of extending over a greater portion of the natural hair of the wearer.

9 Claims, 6 Drawing Figures

PARTIAL WIG ASSEMBLY WITH EXTENSION PORTION

This is a continuation of application Ser. No. 572,304, filed Jan. 20, 1984, now abandoned.

BACKGROUND OF THE INVENTION

1. Field of the Invention

This invention relates to a partial wig assembly of the type specifically structured to position attached hair on top of the head of a wearer in such a manner that it can be intermingled with the natural hair of the wearer, thereby allowing for greater versatility of hair styling or for covering thin hair portions of the scalp of the wearer.

2. Description of the Prior Art and Summary

As is perhaps well known, wigs are often worn by some women to permit ready application of hair styles and color preference without the need of recurring and lengthy visits to beauty parlors for hair styling changes or changes in the color of their hair. This invention relates to a wig for use by women which is in effect a partial wig or hair piece; it does not completely cover the head. It is provided with hair in an intensity pattern and length which adapts it for reasonably prompt styling and intermingling with the hair of the wearer. Specifically, the wig comprises a front portion and an elastic back band which are joined by side bands. To the exterior of the front portion and bands, hair is suitably fastened and arranged in a simulated growth pattern. The wig is adapted to be applied or arranged on the head of a wearer by positioning the portion on the top of the head at or above the natural hair line and by passing the hair of the wearer through the area defined by the bands and front portion so that the back elastic band is underneath the wearer's hair and overlays the neck and the hair of the wig and the hair of the wearer may be intermingled and combined together.

Accordingly, it is an object of this invention to provide a partial wig including a hirsute frontal portion and hirsute side bands connected at the distal ends by an elastic hirsute band which is adapted to overlie a portion of the head and is arranged to remain in position thereon.

It is another object of this invention to provide an extension portion secured to the frontal portion and extending rearwardly thereof to cover an additional portion of the top of the head of the wearer and further to be formed of lightweight, porous, material capable of ventilating the scalp making the overall wig assembly cool and more versatile when worn.

It is a general object of this invention to provide a wig of the type described hereinafter which is relatively inexpensive to manufacture in that it employs a reduced amount of hair, and which is well adapted for various types hair styling.

BRIEF DESCRIPTION OF THE DRAWINGS

For a fuller understanding of the nature and objects of the present invention reference is had to the following detailed description taken in connection with the accompanying drawings in which.

Like reference characters refer to like parts throughout the several views of the drawings.

DETAILED DESCRIPTION OF THE PREFERRED EMBODIMENT

Figure 1:
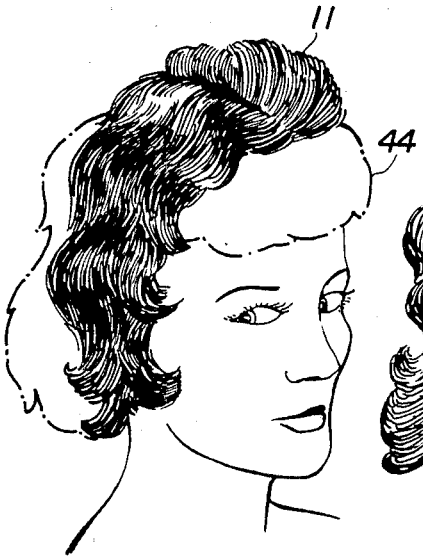
FIG. 1 is a perspective view of the instant invention in position on the head of a wearer.
Figure 3:
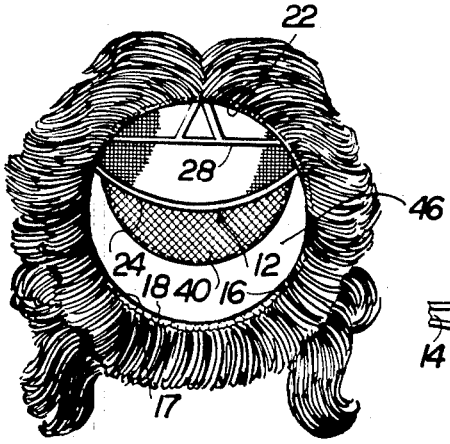
FIG. 3 is a bottom view illustrating the construction of the instant invention.

As shown in FIGS. 1 and 3, the numeral 11 generally represents a partial wig comprising a generally elliptically-shaped hirsute frontal portion or foundation 12 with diverging hirsute side bands 13 and 14 which generally extend in the direction which is parallel to the major axis of the frontal portion, the distal ends 16 and 17 of the side bands 13 and 14 respectively being connected by a hirsute elastic back band 18. In a conventional manner, the exterior surfaces of the frontal portion or foundation and the bands are provided with depending secured and stranded hair 20 which is suitably fastened to the foundation and bands to give the illusion of natural hair when the partial wig is worn on a person.

The foundation 12 is generally elliptical in shape with the front boundary edge 22 adapted to be arranged so as to overlay the hairline of a wearer when in use and to conform thereto and extend substantially to the temple portions of the wearer's head. The rear boundary edge 24 is adapted to overlay the top of the head in a transverse direction along a line spaced rearwardly from the front boundary edge or hairline edge. The front boundary edge and the rear boundary edge 22 and 24 respectively merge to form edges of the relative narrow side bands 13 and 14, one on each side of the foundation 12. The foundation 12 may be of a coarsely woven and stiffened, relatively dense fabric material such as 26 (FIG. 4) and which is adapted to be shaped so as to engage the frontal portion of the person's head with the side bands extending downwardly and rearwardly adjacent the ears of the human head in a path which generally follows that of the hairline.

Figure 5:
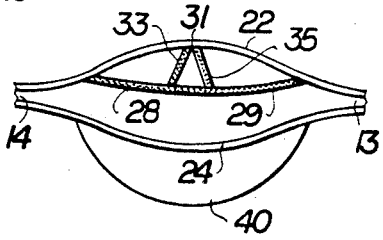
FIG. 5 is a partial view of the wig foundation without hair.

As best shown in FIG. 5, a generally transverse but slightly bowed first ribbon 28 extends along a line substantially parallel to the major axis of the elliptical configuration of the foundation 12 and may be provided to form a longitudinal pocket in which a thin stiffening wire 29 (represented in dotted lines) is disposed. From the mid point 31 of the front boundary portion 22, that point which on the wearer is at the center of the wearer's head, second and third diverging ribbons 33 and 35 respectively extend to the first ribbon 28 to form a diverging pocket therebetween. Reinforcing wires 37 and 39 are provided within each of the ribbons 33 and 35 respectively for reinforcement.

As set forth above, the material of the foundation and side bands is preferably known in the art as vegetable net; however, buckram or any other suitable material having sufficient structural integrity may be used.

In a preferred embodiment of the instant invention, strands of hair 20 are doubled over to form a bight portion 41 which is attached to the base in what is known as a ventilating stitch. The hair on the foundation is secured thereto in a predetermined density and the strands are arranged or applied to the foundation in any of numerous suitable patterns dependent upon the particular application and/or style for which the wig is intended.

Further structural features include the provision of an extension portion 40 secured to and extending rearwardly of the rear boundary edge 24 and into the interior of what may be termed a central aperture 46. The central aperture is bounded by the front boundary portion 22, side bands 13 and 14 and the back band 18 disposed in interconnecting relation to the distal ends 16 and 17 of the side bands 13 and 14 respectively.

The extension portion is formed of a flexible, possibly resilient material having a density somewhat less than the density of the foundation. This lesser density insures adequate ventilation of air therethrough and into exposure with the scalp over which the extension portions 40 is positioned rearwardly of the foundation portion 12. The configuration and structure of the extension portion 40 is such as to have a curvilinear rear peripheral edge being spaced at all points along its length from the continuously formed side bands 16 and 17 and interconnecting back band 18. Such curvilinear configuration of the referred to peripheral edge aids in the conformance in shape of the extension portion 40 to the portion of the head or scalp over which it is positioned.

Figure 2:
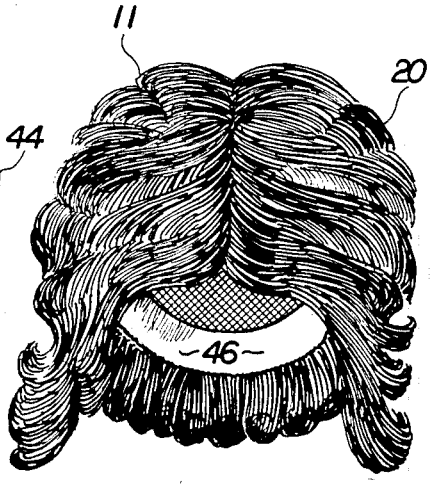
FIG. 2 is a front perspective view illustrating the instant invention.
Figure 4:
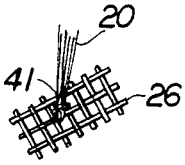
FIG. 4 is an enlarged view illustrating the attachment of the various strands of the hair to the foundation and extension portions of the instant invention.

Further, secured hair 20 is also mounted on the exterior or exposed surface of the extension portion 40 (see FIG. 2) in a manner similar to that disclosed in FIG. 4. However, in a preferred embodiment such hair is arranged to have a density somewhat less than the density of the hair secured to the outer exposed surface portion of the foundation 12. By virtue of this structure, greater versatility is provided in styling of the hair when the partial wig is attached while at the same time providing significant additional body to the natural hair of the wearer. Further, it has been found that for the best effect it is preferred that the hair in the region adjacent the rear boundary edge 34 is preferably longer than the hair in the region adjacent the forward boundary edge 22 but is of less density. Similarly, the hair on the exposed surface of the extension portion 40 may be even of a lesser density so as to provide a gradual thinning of the secured hair and a blending of more natural hair into the intended style. Secured hair is also applied to the side bands 13 and 14 and possibly the back band 18 in a suitable manner; however, it is obvious that this hair is generally shorter than that of the other portions of the wig.

Figure 6:
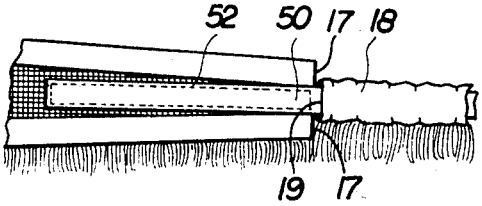
FIG. 6 is a detailed view in partial cutaway and section showing structural details of a fastening structure of the present invention.

A fastening means is further provided in the form of an elastic band or strip disposed on the interior and extending along the length of the back band 18. One free end of this elastic strip 50 extends outwardly from aperture 19 of back band 18 such that a predetermined length can be pulled or slid from the interior of back band 18. This allows an effective tightening of the entire circumference surrounding the central opening or aperture 46, including side bands 13 and 14 and back band 18 and adequate sizing the partial wig about the head of the wearer. When the desired size is reached, the elastic strip or band 50 may be stitched as at 52 or otherwise secured to an exterior surface portion of the one side band 17 as shown in FIG. 6.

In use, the partial wig may be positioned on the head of the wearer with the forward edge spaced rearwardly from the natural hairline and with the elastic back band 18 arranged to overlay the back of the neck of the wearer with the wearer's natural hair being passed through the central opening 46 between the side bands 13 and 14, the foundation 12 and the extension portion 40. The partial wig and the secured hair thereto is then blended with the wearer's natural hair by combing the hair in the region adjacent the forward edge, forwardly and intermingling it by combing the normal front hair designated 44 of the wearer and the longer strands of the hair in the region adjacent to the rearward edge being combed rearwardly so as to overlay and be of a predominant effect in the appearance of the hair on top of the head. Alternately and preferred by some wearers, the wig may be positioned so that the forward edge is coincident with the hairline. In such a use of the partial wig, the application to the head and arrangement thereof is substantially the same.

What is claimed is:

1. A partial wig assembly comprising:

(a) a foundation of flexible sheet material being of predetermined density and including a substantially elliptical configuration generally conforming to the shape of the top of the frontal portion of a human head, (b) said foundation including a front boundary edge and a rear boundary edge both joined at the correspondingly positioned opposite ends thereof and at opposite ends of a major axis of said elliptical configuration, (c) said rear boundary edge extending over the top of the head, between the temple portions thereof, when said front boundary edge is in general registry and alignment with the front hairline, (d) side bands extending from opposite ends of said major axis and said joined boundary edges in spaced relation to one another and rearwardly of said foundation, (e) a back band disposed in interconnected relation between distal ends of said side bands to at least partially define therewith a central opening, said back band extending downwardly and rearwardly to encompass the lower rear portion of the head, (f) said central opening having a substantially closed periphery and being of sufficient dimension to allow passage of natural hair of the wearer therethrough, (g) an extension portion secured to said foundation along said rear boundary edge and disposed to extend into said central aperture therefrom rearwardly of said foundation, (h) said extension portion comprising a frontal portion fixedly secured continuously along a major portion of the length of said rear boundary edge, a rear peripheral edge having a curvilinear configuration, said rear peripheral edge disposed along its length in inwardly spaced relation from said back band and said side bands, (i) said extension portion formed of substantially flexible, porous, air permeable material having a density substantially less than that of said foundation and structured to allow ventilation of the wearer's scalp therethrough, (j) hair secured in selected density to and distributed over an outer surface area of both said foundation and said extension portion, (k) said rear peripheral edge cooperatively disposed with said side bands and said back band to collectively define said closed periphery of said central opening;

(l) said frontal portion of said extension portion mounted contiguous to said rear boundary edge of said foundation and along therewith configured to correspond to the shape of a top portion of the human head, (m) an adjustable fastening means secured to said back band for accomplishing an effective shortening of said back band between said side bands and comprising a strip element movably mounted in hidden disposition on the interior of said back band.

2. A partial wig assembly as in claim 1 wherein said strip element is formed of elastic material and includes one end thereof extending outwardly from said back band a preliminary distance and fixedly attached to one of said side bands, said predetermined distance dependent on the size of the head of the wearer.

3. A partial wig assembly as in claim 1 further comprising a first ribbon secured to the inner surface of said foundation in generally parallel relation to said major axis, and having its ends terminating at said front boundary edge adjacent the ends thereof, and a flexible stiffening wire coextensive with said first ribbon and secured in place between said first ribbon and said foundation.

4. A partial wig assembly as in claim 3 further comprising a second ribbon and a third ribbon each secured to the inner surface of said foundation and extending from a common point midway of the length of said front boundary edge, rearwardly to respective points of intersection and termination with said first ribbon, said second and said third ribbons making equal angles with and respectively opposite sides of a portion of the minor axis of said elliptical configuration, and further including a pair of flexible stiffening wires each secured in place between said foundation and a respective one of said second and said third ribbons.

5. A partial wig assembly as in claim 1 wherein the number of hairs per unit area of foundation in the region adjacent said front boundary edge is greater than the number of hairs per like unit area in the region adjacent said rear boundary edge.

6. A partial wig assembly as in claim 5 wherein the number of hairs per unit area of said extension portion in the region adjacent a front portion thereof is greater than the number of hairs per unit area in the region adjacent a rear curvilinear periphery thereof.

7. A partial wig assembly as in claim 5 wherein the hair in the region adjacent said rear boundary edge is longer than the hair in the region adjacent said front boundary edge.

8. A partial wig assembly as in claim 7 wherein the hair in the region adjacent a front portion of said extension portion is less than the hair in the region adjacent said rear boundary portion of said foundation and less than the hair in the region adjacent said curvilinear rear periphery of said extension portion.

9. A partial wig assembly as in claim 8 further comprising hair secured to and covering an outer surface of said back band being substantially in uniform distribution over the outer surface area thereof.

* * * * *